United States Patent [19]

Herrmeyer

[11] Patent Number: 4,695,083

[45] Date of Patent: Sep. 22, 1987

[54] LATCH FOR PICKUP TRUCK COVER DOORS AND THE LIKE

[75] Inventor: Dennis C. Herrmeyer, Richmond, Kans.

[73] Assignee: Rigid Form, Inc., Richmond, Kans.

[21] Appl. No.: 837,737

[22] Filed: Mar. 10, 1986

[51] Int. Cl.[4] ..... E05C 3/10

[52] U.S. Cl. ..... 292/241; 292/DIG. 43

[58] Field of Search ..... 292/240, 241, 202, 204, 292/341.18, 95, 101, 103

[56] References Cited

U.S. PATENT DOCUMENTS

| | | | |
|---|---|---|---|
| 344,952 | 7/1886 | Duls | 292/341.19 X |
| 761,794 | 6/1904 | Tower . | |
| 1,448,035 | 3/1923 | Ottinger | 292/341.19 |
| 1,573,866 | 2/1926 | Rogers . | |
| 1,916,848 | 7/1933 | North | 292/202 X |
| 2,013,285 | 9/1935 | Mooney | 292/79 |
| 2,385,350 | 9/1945 | Dady | 292/202 X |
| 2,484,514 | 10/1949 | Lane et al. | 296/44 |
| 3,652,112 | 3/1972 | Panelli | 292/210 |
| 3,730,575 | 5/1973 | Arlauskas et al. | 292/216 |
| 3,876,237 | 4/1975 | Hayes, Jr. et al. | 292/202 |
| 4,025,095 | 5/1977 | Hausladen | 292/108 |
| 4,061,371 | 12/1977 | Prather et al. | 292/198 |

*Primary Examiner*—Richard E. Moore

*Attorney, Agent, or Firm*—Litman, Day & McMahon

[57] ABSTRACT

A latch for a pickup truck cover door and the like includes a handle assembly with a pivotable shaft. A lever extends from the shaft and includes a bight section. A hook plate includes inner and outer legs forming a notch therebetween. The latch lever bight section is received in the notch with the latch in its locked position.

1 Claim, 1 Drawing Figure

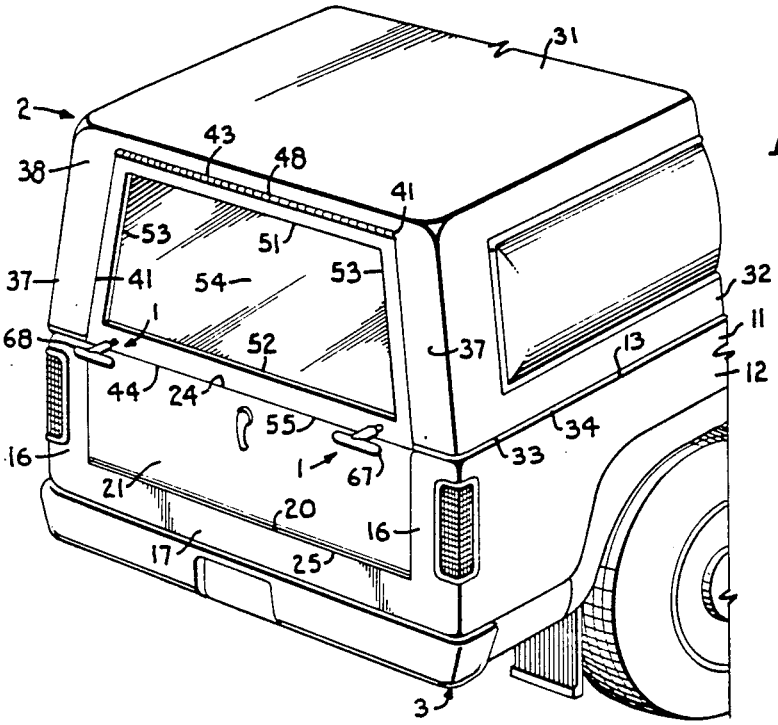
Fig. 1.
Fig. 4.
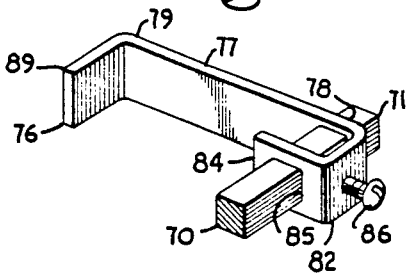
Fig. 2.
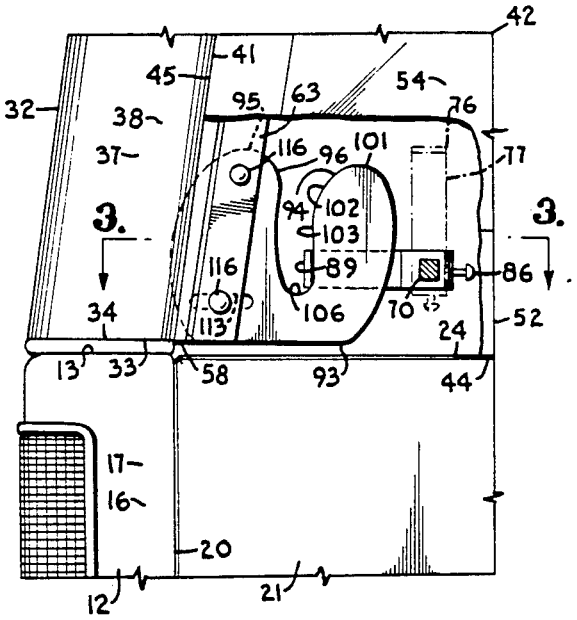
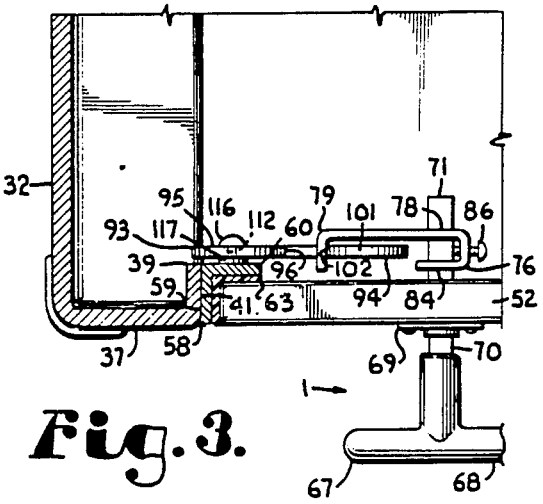
Fig. 3.

LATCH FOR PICKUP TRUCK COVER DOORS AND THE LIKE

BACKGROUND OF THE INVENTION

1. Field of the Invention

The present invention relates generally to latches and in particular to a latch for pickup truck cover doors and the like.

2. Description of the Prior Art

Pickup truck covers or "camper shells" are very popular with pickup truck owners and a wide variety of different styles are presently available. The covers are designed so that their lower edges mate with the upper edges of the pickup truck beds for which they are designed. A usable space is thus enclosed between the upwardly-open pickup truck bed and the downwardly-open cover.

Various materials have heretofore been used to make the covers, including fiberglass, aluminum, steel, plastic and wood. Fiberglass offers the advantage of being relatively easy to form into various configurations in suitable molds.

The space thus enclosed is useful for transporting and storing various types of material which can thus be shielded from the elements and securedly locked within the enclosed space. Also, persons and small animals can occupy the enclosed space. Sleeping accomodations are sometimes provided therein, hence the term "camper shell". If conversion to normal pickup truck configuration is desired, most covers can be easily removed.

Ingress and egress to the enclosed space is generally provided through a door mounted on the cover back end and hinged across its top. The door opening in the back end of a typical cover corresponds to the tailgate opening of the particular pickup truck that it is designed for and is positioned directly thereover. Thus, both the tailgate and the cover door may be opened to provide a relatively large combined opening. The present invention is a latch for the cover door and similar applications.

A problem with many prior art pickup truck covers is that their upper rear corners are susceptible to stress and cracking when they are not mounted on truck beds. Because of the relatively large door opening of the typical cover, the side walls are prone to flexure, which can cause cracking around the back upper corners. Such flexure can occur while the covers are being transported, stored or installed. Most commonly the greatest flexure occurs at the back, lower ends of the side walls whereat they provide relatively long moment arms for cracking the cover at its back upper corners.

Fiberglass and plastic shells are particularly prone to such flexure damage. Furthermore, the shells are preferably formed of relatively thin materials to minimize the weight penalty and production costs incurred therewith, which thin materials tend to increase the aforementioned flexure and cracking problems.

A previous solution to this problem was to secure the lower rear corners of the cover together with a chain or similar tension member. However, the chains are generally removed after the cover is installed and are thus not available for protecting it during later removals and installations. Furthermore, the chains add to the cost of production of the covers without providing any performance advantages.

Yet another problem associated with prior art covers is that their doors are often not adequately secured.

Most camper shell doors include either a single latch in the middle or a pair of latches at either side adjacent to the lower edge. The latches generally include locking cylinders and T-handles. However, many prior art cover doors are relatively easy to force open with a crowbar or similar tool, thus compromising the security of the enclosed space.

Heretofore, there has not been available a latch for pickup truck cover doors with the advantages and features of the present invention.

SUMMARY OF THE INVENTION

In the practice of the present invention, a latch is provided which is adapted for mounting in pairs on a pickup truck cover door. The latch includes a handle assembly with a pivotable shaft extending through the door. A lever is mounted on a front portion of the shaft and includes a rearwardly-extending bight section. A hook plate is mounted on the cover adjacent to a rear opening thereof and includes inner and outer legs forming a notch therebetween. The hook plate notch is adapted to receive the lever bight section with the latch in its locked position. The latch lever bight section cooperates with the hook plate to provide a secure, locking engagement for holding the cover door closed and preventing the sides of the cover from spreading at the cover back end.

PRINCIPAL OBJECTS OF THE PRESENT INVENTION

The principal objects of the present invention are: to provide a latch for pickup truck cover doors and the like; to provide such a latch which is adapted for mounting on either side of a pickup truck cover door; to provide such a latch which is adapted for securing the side walls of a pickup truck cover against spreading when not attached to a pickup truck bed; to provide such a latch which is difficult to force open; to provide such a latch which provides greater security for a space enclosed by the pickup truck cover and bed; to provide such a latch which is adapted for use with pickup truck covers currently in production; and to provide such a latch which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary perspective of a pickup truck and cover with a pair of door latches embodying the present invention.

FIG. 2 is a fragmentary rear elevation of the latch with portions broken away to reveal the construction thereof.

FIG. 3 is a horizontal cross-section of the latch taken generally along line 3—3 in FIG. 2.

FIG. 4 is a fragmentary perspective of the latch, particularly showing the handle shaft and the latch lever.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The relative orientations of the cover including the latch comprising the present invention and the parts thereof are disclosed and described herein with respect to the pickup truck on which the cover is mounted. Thus, "front", "rear" and derivatives thereof, for purposes of this specification, mean to the front and the rear of the pickup truck respectively. The terms "inner" and "outer" and derivatives thereof are used to describe lateral orientation with respect to the longitudinal centerline of the pickup truck. Thus, the directional orientation of FIGS. 2 and 3 is such that the inside is to the right and the outside is to the left.

The reference numeral 1 generally designates a latch embodying the present invention. A pair of the latches 1 are provided on a cover 2 mounted on a pickup truck 3.

The pickup truck 3 includes a bed 11 having side walls 12 with upper edges 13. The side walls 12 turn inwardly and form side wall rear ends 16 at a rear end 17 of the bed 11. A tailgate opening 20 is defined between the side wall rear ends 16 and receives an operable tailgate 21. The tailgate 21 includes an upper edge 24 substantially coplanar with the side wall upper edges 13 and is hingedly attached along a lower edge 25 to the bed 11.

The cover 2 includes a top 31 and a pair of opposed side walls 32 extending downwardly therefrom and sloping slightly outwardly from top-to-bottom. The side walls 32 terminate at lower edges 33 mounting a weatherstrip 34 for engaging the bed side walls 12. The cover side walls 32 turn inwardly to define rear legs 37 at a rear end 38 of the cover 2. The cover side wall rear legs 37 include forwardly-extending flanges 39.

A cover door opening 41 is formed in the cover rear end 38 between the cover side wall rear legs 37. A cover door 42 with upper, lower and side edges 43, 44, 45 is operably mounted in the opening 41 by a hinge 48 extending along its upper edge 43 in proximity to the cover top 31. The door 41 comprises a frame-like assembly with upper, lower and side rails 51, 52, 53 at respective upper, lower and side edges 43, 44, 45. The door rails 51, 52, 53 frame and secure a back door glass pane 54. The lower rail 52 mounts a weatherstip 55 for engaging the tailgate upper edge 24.

A pair of door jambs 58 are attached to the cover rear end flanges 39 on either side of the cover door opening 41. Each door jamb 58 comprises an angle section with a proximate leg 59 attached to the flange 39 and a distal leg 60 extending inwardly from the forward edge of the proximate leg 59 and forming approximately a 90° angle therewith. The door jambs 58 preferably comprise aluminum. Attached to each door jamb 58 is a door jamb weatherstrip 63 with a similar angular configuration in section (FIG. 3) for engaging the door side rail 53. The door jamb weatherstrip 63 is positioned to the inside of the door jamb proximate leg 59 and to the rear of the door jamb distal leg 60.

Each latch 1 includes a T-handle assembly 67 with a handle 68, a mounting plate 69 attached to the door lower rail 52 and a square shaft 70 connected to the handle 68 and journalled in the mounting plate 69. The T-handle assembly 67 is of the type which is currently available and in use on many pickup truck cover doors. Preferably it includes a keyed cylinder lock 72. The shaft 70 includes a front portion 71 which projects forwardly from the front of the lower rail 52.

A latch lever 76 includes an extension section 77 with proximate and distal ends 78, 79. A spacer section 82 extends rearwardly from the extension section proximate end 78 and forms an angle of approximately 90° therewith. A return section 84 extends from the spacer section 82 in parallel, spaced relation with the extension section 77 whereby the edges of the extension section proximate end 78, the spacer section 82 and the return section 84 define a U-shaped configuration as shown in FIG. 3.

The extension proximate end 78 and the return section 84 include aligned square receivers 85 adapted to receive the shaft 70 in non-rotatable engagement. A lever set screw 86 extends through a threaded receiver in the return section 84 for securely mounting the lever 76 on the shaft 70. As shown in FIG. 3, the lever 76 is preferably mounted with its return section 84 spaced slightly in front of the front face of the door lower rail 52.

A bight section 89 of the lever 76 extends rearwardly from the extension distal end 79 and forms approximately a 90° angle therewith. The spacer and bight sections 82, 89 are substantially parallel.

The latch 1 also includes a hook plate 93 with inner and outer legs 94, 95 separated by a notch 96. The inner leg 94 has a rounded upper end 101, a cam lobe 102 projecting downwardly and outwardly from the upper end 101 and a substantially straight notch edge 103 extending downwardly from the cam lobe 102. The notch 96 terminates at a lower end 106 between the hook plate inner and outer legs 94, 95.

The outer leg 95 includes a notch edge 109 positioned opposite the inner leg notch edge 103 and upper and lower fastener receivers 112, 113. The upper fastener receiver 112 is substantially circular and the lower receiver 113 comprises a transversely extending slot. Mechanical fasteners 116 such as rivets, screws, etc. are provided for mounting the hook plate 93 on the front face of the door jamb distal leg 60. Washers 117 are provided therebetween to space the hook plate 93 slightly forwardly from the door jamb distal leg 60. The slotted lower fastener receiver 113 allows the hook plate 93 to be rotated slightly relative to the door jamb 58 to adjust the position of the notch 96 with respect to the latch lever 76.

In operation, the cover door 42 can be opened and closed with the levers 76 in their respective vertical, unlocked positions, which generally correspond to the handle 68 being vertically aligned. To lock the door 42 in its closed position, the handles 68 are turned (left handle counterclockwise; right handle clockwise) so that each lever bight section 89 engages a respective cam lobe 102. The cam lobe 102 is preferably positioned further than the notch edge 103 from the rotational axis of the shaft 70 so that some resistance to rotation is encountered as the bight section 89 slides along the cam lobe 102. Turning the handle 68 then becomes slightly easier as the bight section 89 slides along the notch edge 103 to its locked position adjacent the notch lower end 106. The bight section 89 is thus retained in its locked position by the cam lobe 102.

With the latches 1 in their locked positions, the lever extension sections 79 are positioned slightly in front of the hook plate inner legs 94 so that the cover door 42 is securely retained against the door jambs 58 and the tailgate upper edge 24. Furthermore, the cover side wall rear legs 37 are prevented from spreading outwardly by the engagement of the lever bight sections 89 on the hook plate inner legs 94.

With the cover 2 closed and locked, the cooperation between the bight sections 89 and the hook plates 93 makes it considerably more difficult to pry open the cover door 42 than it would be with other latches lacking the bight section 89. With such other latches, pickup truck cover doors could often be forced open with a prying instrument inserted between the tailgate and the door lower edge whereby the latch levers would be pulled loose, even if latch levers were provided on both sides. With the present arrangement, however, the latch lever extension sections 77 are placed in tension with the door closed by the engagement of their respective bight sections 89 with respective hook plate inner legs 94 whereby the door 42 is more difficult to force open than it would be if the bight sections 89 were omitted.

Another important advantage of the disclosed lever bight section 89 and hook plate 93 configuration relates to protecting the cover 2 when it is not installed on the pickup truck 3. Pickup truck covers, particularly those made of fiberglass, are susceptible to cracking in the area of their upper rear corners. Such cracking can occur if the side walls 32 are flexed as is likely when they are not securely mounted on a pickup truck bed. Because of the relatively long moment arm presented at the side wall rear legs 37, a relatively small amount of force at their lower ends is leveraged into a relatively large stress at the upper rear corners of the cover. The latch 1 of the present invention is adapted to relieve this problem because, with the latches 1 in their locked positions, they tend to hold the side wall rear legs 37 together, especially at their lower ends and prevent, or at least limit, such damaging flexure as might otherwise occur.

In addition to the aforementioned advantages, the latch lever 76 provides a hook for suspending various articles when the cover door 42 is open. For example, a lantern or other object may be suspended from one of the latch levers 76 with the cover door 42 in its open, substantially horizontal position. The lever bight section 89 extends upwardly when the cover door 42 is open and thus retains a suspended article on the latch lever 76.

It is to be understood that while certain forms of the present invention have been illustrated and described herein, it is not to be limited to the specific forms or arrangement of parts described and shown.

What is claimed and desired to be secured by Letters Patent is as follows:

1. In combination with a pickup cover having: a top; opposed side walls; a rear end with a pair of coplanar side wall rear legs and a pair of flanges extending forwardly from said cover side wall rear legs, said flanges defining a cover door opening therebetween in said cover rear end; a cover door having upper, lower and opposite side edges with upper, lower and opposite side rails located thereat with said upper rail being hingedly connected to said cover rear end and said lower rail having a back surface, the improvement of a latch mechanism, which comprises:

(a) a pair of angle-section door jambs each having:
  (1) a proximate leg with inside and outside faces, said proximate leg being mounted on said cover side wall flange with its outside face against said cover side wall flange; and
  (2) a distal leg extending from said proximate leg at a right angle and lying in a plane parallel to a plane formed by said shell rear end, said distal leg having front and back faces;

(b) a pair of elastomeric door jamb weatherstrips each including:
  (1) a proximate leg mounted on the inside face of a respective door jamb proximate leg; and
  (2) a distal leg mounted on the rear face of a respective door jamb distal leg whereby said door jamb and said door jamb weatherstrip distal legs project inwardly into said cover rear opening in opposed relation;

(c) a pair of handle assemblies each mounted on said lower rail in proximity to a respective said rail and including:
  (1) a handle assembly plate mounted on said lower rail back surface;
  (2) a T-handle;
  (3) a shaft selectively rotatably journalled in said mounting plate and said lower rail, said shaft having a rear portion projecting rearwardly from said mounting plate and mounting said handle and a front portion projecting forwardly from said lower rail;
  (4) a keyed lock cylinder located in said handle and having an open position permitting said shaft to rotate with respect to said lower rail and a locked position preventing rotation of said shaft with respect to said lower rail;
  (5) a lever mounted on said shaft front portion and including: an extension section with proximate and distal end; a spacer section extending from said extension section proximate end; a return section extending from said spacer section, said extension and return sections being substantially parallel and including aligned, square receivers adapted for receiving said shaft in a nonrotatable engagement; and a bight section extending rearwardly from said extension section distal end in substantially parallel, spaced relation from said spacer section, said spacer and bight sections extending at substantially right angles from said extension section proximate and distal ends and said spacer section having a threaded receiver extending therethrough parallel to said extension and return sections;
  (6) a set screw threadably received in said spacer section receiver whereby said lever is fixedly mounted on said shaft; and (d) a hook plate including:
  (1) an inner leg having an upper end, a cam lobe located below and outwardly from said upper end and a substantially vertical notch edge located below said cam lobe;
  (2) an outer leg integrally connected to said inner leg and having a first fastener receiver and a slotted second fastener receiver;
  (3) a pair of fasteners extending through said outer leg fastener receivers and a respective door jamb distal leg whereby said hook plate outer leg is fastened on the front face of said door jamb distal leg in spaced relation from said door lower rail with said door in its closed position; and (4) a notch defined between said inner and outer legs and having a notch lower end whereat said inner and outer legs are connected and adjacent to said notch edge, said notch being adapted to selectively receive said lever bight section with said latch in its locked position;

(e) said lever bight section being slidable along said inner leg cam lobe and said notch edge when said handle assembly is turned to its locked position;

(f) said hook plate inner leg notch edge being located substantially level with said shaft when said door is in its closed position and said hook plate inner leg cam lobe being located further from said shaft rotational axis than said inner leg notch edge;

(g) said lever being subjected to a first tensile force with said bight section engaging said cam lobe and a second tensile force with said bight section engaging said notch edge, said first tensile force being greater than said second tensile force; and (h) said cover side wall rear leg being prevented from spreading outwardly with respect to said door by said lever tensile forces and said engagement of said lever bight sections with said hook inner leg notch edges.

* * * * *